US005791518A

United States Patent [19]

Amann et al.

[11] Patent Number: 5,791,518

[45] Date of Patent: Aug. 11, 1998

[54] DISPENSER FOR DISCHARGING MEDIA

[75] Inventors: Esther Amann; Karl-Heinz Fuchs; Stefan Ritsche, all of Radolfzell, Germany

[73] Assignee: Erich Pfeiffer GmbH, Germany

[21] Appl. No.: 549,458

[22] Filed: Oct. 27, 1995

[30] Foreign Application Priority Data

Oct. 27, 1994 [DE] Germany ..... 44 38 375.4

[51] Int. Cl.[6] ..... B67D 5/22

[52] U.S. Cl. ..... 222/38; 222/321.9; 222/538

[58] Field of Search ..... 222/14, 16, 30, 222/33, 36, 38, 321.7, 321.9, 536, 538

[56] References Cited

U.S. PATENT DOCUMENTS

| | | | |
|---|---|---|---|
| 3,474,941 | 10/1969 | Sundholm . | |
| 4,280,291 | 7/1981 | Mayners . | |
| 4,565,302 | 1/1986 | Pfeiffer et al. . | |
| 4,865,230 | 9/1989 | Tugwood | 222/538 X |
| 4,932,569 | 6/1990 | Ruscitti et al. . | |
| 5,174,473 | 12/1992 | Marelli . | |
| 5,209,375 | 5/1993 | Fuchs . | |
| 5,228,586 | 7/1993 | Fuchs . | |
| 5,271,538 | 12/1993 | Lipker et al. . | |
| 5,277,334 | 1/1994 | Malinconico . | |
| 5,289,946 | 3/1994 | Fuchs . | |
| 5,335,823 | 8/1994 | Fuchs et al. . | |
| 5,335,830 | 8/1994 | Cater . | |

FOREIGN PATENT DOCUMENTS

| | | |
|---|---|---|
| 090659 | 10/1983 | European Pat. Off. . |
| 194337 | 9/1986 | European Pat. Off. . |
| 269496 | 6/1988 | European Pat. Off. . |
| 8914879 | 12/1989 | European Pat. Off. . |
| 525476A2 | 2/1993 | European Pat. Off. . |
| 525476A3 | 2/1993 | European Pat. Off. . |
| 443835 | 5/1927 | Germany . |
| 558394 | 9/1932 | Germany . |
| 701539 | 1/1941 | Germany . |
| 1693483 | 2/1953 | Germany . |
| 3225910 | 1/1984 | Germany . |
| 3302160 | 7/1984 | Germany . |
| 3541378 | 5/1986 | Germany . |
| 4027672 | 3/1992 | Germany . |
| 4030530 | 4/1992 | Germany . |
| 3308614 | 12/1993 | Germany . |
| 2001127 | 11/1979 | United Kingdom . |

*Primary Examiner*—Gregory L. Huson
*Attorney, Agent, or Firm*—Quarles and Brady

[57] ABSTRACT

A discharge apparatus has an indicating device which can be set to different numbers of pump strokes with a handle and which can be operated rearwards by one step by each pump stroke performance. A pivot spout forming the medium outlet is formed by a tube with constant cross-sections. For securing the position of the discharge actuator and the spout there is a common securing device. The medium outlet can be closed in pressure-tight manner by a closure formed by the device. An outlet channel forms a channel system for the preparation of the medium during flow. This leads to a use-advantageous discharge apparatus.

46 Claims, 1 Drawing Sheet

DISPENSER FOR DISCHARGING MEDIA

BACKGROUND OF THE INVENTION

The invention relates to a discharge apparatus for media, which can be liquid, gaseous, pasty and/or pulverulent, and which can be discharged from two or more separate pressure chambers or reservoirs.

According to the invention the discharge apparatus has, one, two or more times a body, a discharge actuator with handle, a medium outlet, an indicating or determination device with handle, a servodrive, a discharge deliverer or a pump, a pressure chamber for delivering the medium, a medium reservoir, an actuating or discharge head, an outlet channel, an outlet valve, an inlet channel, an inlet valve, a pump piston unit, etc., which can in each case form means, arrangements or members for different functions.

OBTECTS OF THE INVENTION

Objects of the invention are to provide a discharge apparatus for media of the aforementioned or other types, which obviates the disadvantages of known constructions and which in particular ensures a simple determination of data relating to discharge apparatus functions and/or reliable transfer or use in different use states.

SUMMARY OF THE INVENTION

According to the invention a discharge apparatus for flowable or other media has means through which it is possible to manually set a predetermined number of identical or different determination processes initially on a control member, whereby said control member can be returned to a starting position by a number of manual step actuations corresponding to the aforementioned number. From said starting position or any other position the control member or determination device can then be manually transferred again into any random other position or presetting. For carrying out this presetting appropriately there are no preparatory manipulations, e.g. unlocking or the like and instead said presetting can be carried out at a position of the discharge or determination actuator, particularly in the inoperative or starting position. It is also advantageous if the presetting and actuation take place by means of separate handles and/or in different actuating directions, which can be at right angles to one another.

If a determination device is used for determining or counting successive discharge processes or strokes, this leads to a very simple, variable dosing of the medium quantity to be discharged for a particular use or for a use during a particular time period, e.g. one day. The medium quantity to be discharged with a single discharge or actuation cycle can be chosen sufficiently small so that it is in no case excessive. Through several successive discharge cycles this medium quantity can be randomly multiplied, in that the aforementioned presetting is made. For presetting purposes the determination device can be rapidly adjusted in random manner in two opposite directions with respect to its control movement. The succeeding determination control movement is preferably always in the same direction.

A determination device can be constructed according to U.S. Pat. No. 5,228,586, U.S. Pat. No. 5,335,823, U.S. Pat. No. 5,289,946, U.S. Pat. No. 5,209,375, U.S. Pat. No. 5,277,334 and/or U.S. Pat. No. 4,565,302, to which reference should be made for further details and actions for incorporation into the present invention. In addition to a body carrying a reservoir or discharge deliverer and an actuating or discharge head movable with respect thereto, a determination or indicating device additionally has a single and in particular one-piece or substantially dimensionally stable determination member, which is exclusively mounted on one of the two other parts and may or may not be fitted without this impairing or disturbing the discharge function or the connection to the discharge deliverer or the medium reservoir. Thus, with otherwise identical components, the discharge apparatus can be equipped by the omission or non-destructive removal or adding of a third component with or without a determination function.

Independently of the described functions the discharge apparatus advantageously has means with which the medium outlet can be oriented, e.g. continuously with respect to a main or median or actuating axis of the discharge apparatus in different directions and can be secured in at least frictionally engaging self-locking manner in the particular position. Advantageously the medium outlet leading to the open, where the medium flow or jet is completely detached from the discharge apparatus, is provided at the free end of a spout, nozzle, cannula, tube or some similar connection, which can be substantially dimensionally rigid or flexible or elastically resilient transversely and/or parallel to its longitudinal direction. In at least one or all the orientations the connection which is linear in the starting state diverges from a right-angled position with respect to the main axis and it can be located in a position parallel and laterally displaced with respect to the main axis or in a single plane in all the positions which can be roughly parallel to an axial plane of the main axis and is located with radial spacing outside the exterior of the actuating head or determination device. The connection can be pivotable about an axis at right angles to the main axis and which is spaced from the inlet-side end of the connection, said spacing being at the most as large as the greatest inside width of an associated outlet channel.

The length of the connection is at least five or ten times its outside width, the connection having at least over all the part of its length exposed during discharge constant outside and/or inside cross-sections. The connection can be produced by cutting to length from a prefabricated tube, which has over its entire length constant cross-sections. However, appropriately the connection in no position projects significantly over the end of the particular of the three mentioned components facing the reservoir, so that also when in the non-use position it is not adjacent to the outside of the storage vessel and instead at least in the starting position of the discharge apparatus only extends over that part of its length, which is determined by the preassembled unit of the two or three aforementioned components. The mounting of the connection is immediately adjacent to the end of said unit remote from the reservoir. When the discharge deliverer is inserted in said unit it can project over the end of the unit facing the reservoir with its associated end and which is used for feeding medium from the storage vessel into the discharge delivering means.

Also independently of the described functions appropriately means are provided in order to atomize or nebulize a medium at an optionally larger distance from the medium outlet within the outlet paths leading thereto and to supply same as an atomized flow through the following outlet channel to the medium outlet and to discharge same in atomized form without any further atomizing, the medium flowing from the outlet of a pressure generator, via the atomizing means out of the medium outlet in the form of a continuous flow. The valve-free flow path from a pressure chamber or an associated outlet valve to a whirling or atomizing nozzle issuing into the atomizing chamber and the valve-free flow path from the atomizing chamber to the medium outlet can be of roughly equal length or any of the said two flow paths can be shorter than the other and in particular at the most shorter by half its length. The whirling or flow chamber can be linear and have approximately constant inside cross-sections over its length, especially round or circular inside cross-sections.

In order to mutually positively and/or non-positively secure rotary and/or axial positions of any of said components or to tightly close the outlet channel or medium outlet, there is appropriately a disengageable or releasable locking mechanism, which is free or freely accessible in the vicinity of an outermost wall, such as a jacket wall of the preassembled standard component or to the outside in spaced manner therefrom. The locking force can be transferred exclusively via the connection to the discharge head, whereas it is transferred to the second body, e.g. the base body appropriately by means of a freely projecting projection, which simultaneously secures in non-destructively, easily disengageable manner the associated end of the connection or some other rod-like securing member.

BRIEF FIGURE DESCRIPTION

These and further features can be gathered from the claims, description and drawings and the individual features, either singly or in the form of subcombinations, can be implemented in an embodiment of the invention and in other fields and can represent advantageous, independently protectable constructions for which protection is hereby claimed. An embodiment of the invention is described in greater detail hereinafter relative to the drawings, wherein show:

FIG. 1 A discharge apparatus according to the invention in a part sectional view.

FIG. 2 A detail plan view of the discharge apparatus of FIG. 1.

FIG. 3 A detail of the discharge apparatus of FIG. 1 in cross-section.

DETAILED DESCRIPTION OF THE PREFERRED EXAMPLE EMBODIMENTS

Figures 1, 2, 3:
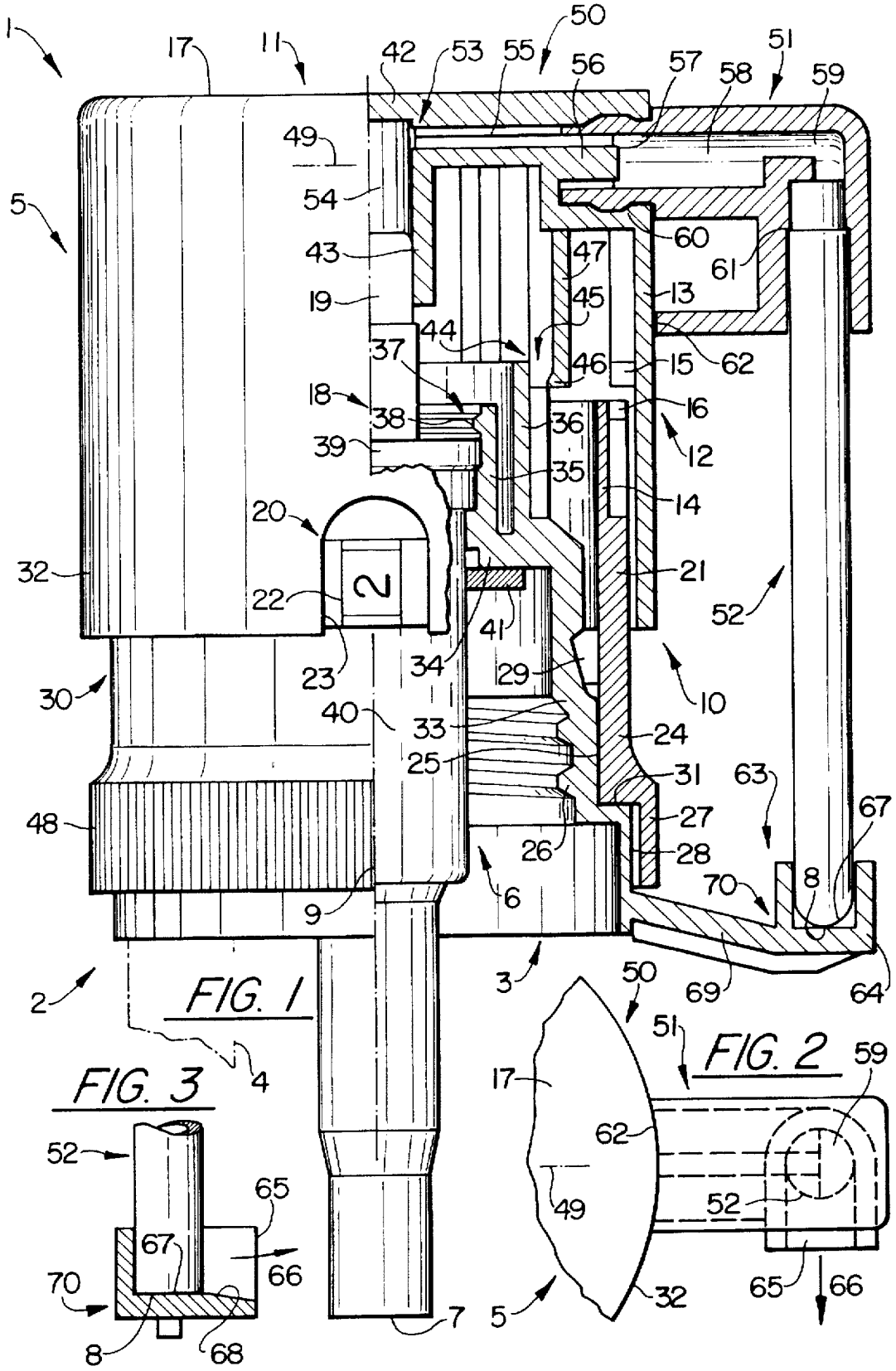

The one-handed, freely carryable and simultaneously operable discharge apparatus 1, which can be constructed for medium discharge in droplet form, as a foam strand, etc., has a body 2, which is essentially formed by a support body 3 and a bottle-like reservoir 4 and which is dimensionally stable. Discharge operation takes place by means of an actuator 5, through which a pressure or pump chamber of a discharge deliverer 6 is continuously constricted and in this way the medium is brought under discharge pressure. The discharge deliverer can be an elongated thrust piston pump and has at its end located within the reservoir 4 an inlet 7 through which the medium during a stroke movement, namely during the return stroke, is delivered or sucked into the pressure chamber from the reservoir 4 by means of a one-way inlet valve located within the deliverer 6. During the oppositely directed stroke the medium is delivered to a medium outlet 8 from the pressure chamber by means of a pressure and/or a path-dependently opening outlet valve, opposite to the inlet valve within the deliverer 6 and at whose outlet opening the medium completely passes into the open from the discharge apparatus 1. Each of the components or means 2 to 7 is approximately in or parallel to a main axis 9 of the apparatus 1.

For determining the discharge processes and the like a determining device 10 is provided, which is to be actuated with an actuator 11. This actuator 11 can be separate from the actuator 5 or, as shown, can be formed by the latter, so that an operation of one actuator always brings about an operation of the other actuator. Through the actuator 5, 11 a servodrive 12 is driven, which only has a single driving stage of two sleeve-like and roughly coaxial control members 13, 14. The outer, driving control member 13 has control cams 15 distributed over its inner circumference and with which on the outer circumference of the driven control member 14 are associated countercontrol cams 16. The control cams 15, 16 can be formed by the facing ends of axial webs or axial slot sides and have circumferentially bevelled cam faces, which bring about a rotary movement about an axis 9 in the case of mutual, sliding engagement. In the starting position of the apparatus 1 according to FIG. 1 the control members 13, 14 or the driving members 15, 16 are completely out of reciprocal engagement, so that they do not impede a reciprocal rotary movement. The control member 13 is fixed or in one piece with a finger pressure handle 17 of the actuator 5, 11, said handle 17, transversely to the axis 9, being located on the outermost end side of the apparatus 1 remote from the reservoir 4 and axially spaced from the servodrive 12.

The handle 17 simultaneously also moves a stroke piston unit 18 of the deliverer 6, which carries on a piston ram 19 the valve body and the valve seat of the outlet valve and the valve body opening and closing through the axial movement can be formed by a piston sleeve surrounding the ram and which simultaneously forms the pump piston for narrowing and widening the pump chamber. The end of the piston ram 19, which is directed away from the reservoir 4 and projects over the body 2 or 3, is rigidly connected to the handle 17.

There is also an indicating device 20 for the optical indication of discharge processes, etc., which can be actuated by the actuator 5, 11 or the handle 17 and in particular by means of the same servodrive 12 as the determination device 10, whose determination positions can consequently be indicated and read off to the outside by means of the indicating device 20. The sleeve-like determination member 21 of the device 10 is connected axially and directly to the control member 14 with which it is connected in fixed or one-piece manner. On its outer circumference the determination member 21 has a scale 22 of the device 20 with symbols, e.g. numbers rising from zero in ones and which can be distributed as cardinal or ordinal numbers uniformly over the entire circumference of the determination member 21. With the scale 22 is so associated an indicating countermember 23, that in each case only one symbol is visible for optical detection and reading. The countermember 23 can be formed by an edge-open window cutout at the end of a jacket, which is fixed or in one piece with the component 13, 15, 17.

Component 14, 21 is connected in fixed or one-piece manner to a sleeve-like bearing member 24, which is mounted in rotary manner about the axis 9 of the body 2, 3 with a radial bearing 25. The cylindrical bearing 25 is spaced from the determination member 21 on its side remote from the arrangement 12, 14 in an axial area coinciding with the axial extension of a fastening member 26, which is used for the tensioned fastening of the support body 3 to the neck of the reservoir 4. The fastening member 26 is here an internal thread, but can also be a plug-in member, a crimp ring, etc. Axially and immediately adjacent to and connected to the bearing 25 is provided a locking device, through which the component 14, 16, 21, 24 can be fixed in successive rotary steps relative to the components 2, 17 or the parts connected in fixed or rotation-fixed manner thereto and in resilient or locking manner so that by applying a correspondingly high control force this locking effect can be overcome and is reestablished automatically in a following rotary position. The locking system can only allow the rising or falling rotation direction relative to the scale numbers and positively locks with respect to the opposite rotation direction or can allow both rotation directions overcoming identical or different control forces and in each case over complete rotations. The driving force of the actuator 5, 11 is sufficient to overcome the locking means. On the side remote from the parts 14, 16, 21 a sleevelike locking member 27 is directly connected to the part 24 and is connected in stable or one-piece manner to the relevant part and its inner circumference engages by means of a locking tooth system 28 in an outer circumference of the body 2, 3.

Between the parts 14, 16, 21 on the one hand and 24, 27 on the other an axial bearing 29 is provided for the same and can be formed by a projection projecting over the inner circumference such as a collar or circumferentially distributed cams. This projection engages in rotary and approximately axial clearance-free manner in a ring groove on the outer circumference of the body 2, 3 and simultaneously forms a radially resilient snap member, which during axial mounting of said parts on the body 2, 3 initially widens and then resiliently jumps into the groove, so that the parts can be fitted by a reciprocal axial plug-in connection. At the end of the plug-in movement the parts connected to the projection strike with an inner ring shoulder against an outer ring shoulder 31 of the body 2, 3, which projects over the outer circumference of the bearing 25 and is connected with its outer circumference to the locking teeth 28 and a smooth sliding face is formed. The parts 14, 16, 21, 24, 27 are formed by a one-piece sleeve body 30, whose outer and/or inner circumference passes cylindrically and with a constant width from the part 24, 27 to its end having the cams 16. However, immediately following on to the bearing 25 there is projection over the inner circumference of the projection of the bearing 29. From the bearings 25, 29 the body 30 projects freely to its end associated with the servodrive 12 in such a way that its inner and/or outer circumference is contact-free, said longitudinal portion forming the parts 14, 16, 21. The inner and/or outer circumference of the member 27 is widened and it forms the associated other end of the sleeve body 30, which extends approximately up to the associated end of the body 3 or is only set back slightly with respect thereto.

The actuator 5, 11 has a cap-like actuating body with a jacket 32 projecting freely to the reservoir 4 from the handle 17 and which over most of its length has constant inside and/or outside cross-sections, forms the control member 13 close to the handle 17 fixed thereto and projects axially over the control cam 15 to such an extent that it surrounds the parts 14, 16, 21, 22 or the freely projecting end of the body 30 on the outer circumference with a narrow gap spacing. The countermember 23 is provided in the form of an opening at the open end of this jacket portion.

The cap-like body 3 is also essentially formed by a jacket 33 and an end wall 34, the jacket 33 forms on the inner circumference the member 26, and the outer circumference the bearing surface for the bearing 29 and the associated teeth of the locking tooth system 28, the bearing surface of the bearing 25 and the planar shoulder face 31 between the faces 25, 28. The inner circumference of the jacket 33 stepped widened to the open cap end surrounds the deliverer 6 with radial spacing and is connected with its other end further removed from the reservoir 4 in one piece manner to the end wall 34. Over the outside of the end wall 34 projects freely a support member or a sleeve-like member 35, in which the deliverer 6 engages in axial and radial clearance-free secured manner so that it passes through in closely traversing manner the interior of the sleeve 35 and the end wall 34, but projects in contact-free manner up to the inlet 7. The deliverer 6 is fixed by a connection 37 or an axial snap connection without any separate seal and in sealed manner to the body 3 and during the axial insertion of the deliverer from the outer end of the body 3 or sleeve 35 initially gives way in resilient manner and then springs back into the retaining position. The deliverer 6 and body 30 with the associated parts can be fixed in random order and the same plugging direction to the body 2, 3. On the inner circumference of the sleeve 35 and immediately adjacent to its free end is provided a snap member 38, e.g. a circular bead projection or a ring arrangement of mutually spaced cams, which in the retaining position engages over the end face of a flange 39 of the deliverer 6. The other, remote end face of the ring flange 39 engages on an inner ring shoulder of the sleeve 35. The flange 39 can be formed by a casing or cylinder cover, which is placed on the associated end of the elongated main or cylinder casing 40 of the deliverer 6 and is traversed by the ram 19. The flange 39 projects over the outer circumference of the casing 40, which at the inner face of the end wall 34 is closely surrounded by a ring disk-like seal 41, which is axially secured between said end face and the end face at the end of the neck of the reservoir 4.

The handle 17 is formed by the outer face of an end wall 42, which is constructed in one piece with the jacket 32 and does not project over its outer circumference. Over the inner front side of the wall 42 projects axially a sleeve-like connecting member 43, whose end is so engaged on the free end of the ram 19 that the ram 19 is connected by only frictional engagement or force fit to the parts 13, 15, 17, 32, 42 and can therefore be easily removed in non-destructive manner.

Following the fitting of units 6, 30 said parts are fixed with the same plugging direction as the latter to the prefitted standard component, but are axially movable-with respect thereto.

The body with the associated parts forming the handle 17 is rotation-secured in substantially clearance-free manner in all axial positions, i.e. also in the starting position, with respect to the body 2, 3 by a rotation preventing means 44. For example, on the inner circumference of a sleeve or segmental axial projection 47 positioned in spaced manner from and between the jackets 13, 43 can be provided axial webs, which engage in axial grooves on the outer circumference of a sleeve 36, which surrounds the latter with a limited gap spacing, project in one from the end wall 34 and further than the part 35. The jacket 47 or axial webs are in turn free from the inside of the end wall 42 and project by roughly the same amount as the cams 15. In order to avoid an unintentional removal of the cap body from the unit 2, 3, 6, 30, a positive or non-positive removal preventing means 45 is provided, which prevents by stop action a movement of the cap body enclosing the handle 17 beyond the starting position and is provided on at least one circumferential surface. Appropriately the jacket 47 has on its free end a ring or ring segmental locking cam 46 projecting over its inner circumference and which engages between the axial grooves in uniformly circumferentially distributed countercams, which are provided on the outer circumference of the jacket 36 in the vicinity of its free end. If a sufficiently high removal force is exerted, it is still possible to detach and remove in non-destructive manner the cap body.

The outer circumference of the body 30 exposed at each stroke position of the actuator 5, 11 forms a rotary handle 48 for the random rotation of the particular part fixed to the body 30 with respect to the unit 2, 3, 5, 11, 17, so that the scale 22 can be randomly set with respect to the countermember 23 whilst overcoming the locking means 28. If the actuator 5, 11 is then pressed with a finger of the hand gripping the unit 2 axially counter to the tension of a return spring, then the control members 13, 14 come into reciprocal control engagement and rotate the body 30 about an indicating spacing of the scale 22, so that the next lower number passes into the circumferential area of the countermember 23, but is initially covered by the jacket 32. If the handle 17 is freed, the return spring located within the casing 40 or pressure chamber and acting on the unit 18 moves back the cap body to the starting position, so that the newly set symbol of the scale 22 is visible in the countermember 23. The width of the outer circumference of the cap body roughly corresponds to that of the parts 27, 48. When the preset actuations have been performed, the actuator 5, 11 can be unlocked or locked with respect to further discharge operation, e.g. by the cam 15 striking on the face of the control member 14.

The cap body forms a discharge or actuating head 50, on which is mounted so as to rotate about an axis 49 a spacer 51 carrying the medium outlet 8 and which intersects at right angles the axis 9 or is at right angles to the axial plane of the axis 9 which forms the median plane of the countermember 23. The spacer 51 forms a thin casing with a larger hollow volume than its wall volume and carries in spaced manner with respect to the outer circumference of the head 50 a rod or tube-like, linear spout 52, the spacing being at least as large or larger than the outside width of the tube 52. From the outlet valve a valve-free outlet channel 53 passes through the interior of the pump piston and the piston ram 19 up to the outlet opening 8 and following on to the ram 19 within the member 43 a channel portion 54 located in the axis 9, then in the end wall 42 a channel portion 55 at right angles thereto, at its end a nozzle 56 issuing on the inlet side into a chamber 58 and at its opposite outlet end forms an angular channel portion 59, which directly issues into the end of the tube 52 remote from the outlet opening 8. The passage cross-sections of the portion 54 are much larger than those of the portion 55 or 59 or the channel portion issuing therein from the ram 19 and can also be larger than those of the chamber 58. The passage cross-sections of the portion 55 are much smaller than those of the chamber 58 and also smaller than those of the portion 59 or the tube 52, which can be larger than those of the portion 59. The passage cross-sections of the chamber 58 are larger than those of the portion 59 and the tube 52, the chamber 58 can be axially parallel eccentric or equiaxial to the nozzle 57 optionally provided in a ring system. The chamber 58 is located in the axis 49.

The spacer 51 is mounted in rotary manner on the head 50 with a bearing 60, the spacer 51 having a sleeve-like projection for this purpose with which it is inserted in the outer circumference of the head 50 immediately adjacent to the handle 17 directed radially against the axis 9. On the outer circumference the projection forms a snap member, which engages in self-locking manner in a countermember in an inner circumference of the head 50, so that solely as a result of this the spacer 51 is axially positionally secured relative to the head 50. In the inner circumference of the projection engages a core body 56 of the head 50. The core body 56 fixed or in one piece with the head 5 or the end wall 42 forms a radial bearing pin of the bearing 60 and on its free end bounding the rear end of the chamber 58 forms the nozzle 57, constituted by the associated end of the channel portion 55. The core body 56 can have circumferentially distributed projections or axial webs, which engage in sliding manner in the inner circumference of the spacer 51 adjacent to the chamber 58 and passes with constant width over the chamber 58 to the end of the bearing projection. The core body 56 is approximately in the same axial area as the snap connection and radially supports the latter. The tube 52 at right angles to the axis 49 is fixed with its associated end in a plug opening of the spacer 51 and is inserted in stop manner with its end face axially and at this end part of its passage cross-section adjacent to the mouth of the portion 59 is covered by a stop projection of the spacer 51. The tube 52 rigidly secured on the spacer 51 or the exposed outlet opening 8 can therefore be adjusted by complete rotations with respect to the head 50 and secured in frictionally engaging manner in the positions set.

The medium passing from the pressure chamber via the ram 19 into the channel portion 54, is initially flow-calmed in this portion and then flows at a much higher speed through the channel portion 55 and via the nozzle 57 either enters the chamber 58 in atomized form or flows within the latter accompanied by flow calming. The thus prepared medium, which can undergo atomization in the portion 54, is then again accelerated in the channel portion 59 and then, optionally accompanied by atomization at the end of the portion 59, is introduced into the widened passage channel of the tube 52. If the medium is atomized in this way, it flows through the tube 52 as an atomized flow, which leaves the medium outlet 8. However, the medium can also leave the outlet 8 as unatomized, concentrated flow.

For substantially all the mutually movable components or portions, whereof each can form a or the body of the apparatus 1, a position securing means 63 is provided, which contains one or more solely force-releasable locking mechanisms. In the vicinity of the inserted end 61 of the spout 52 could be provided a catch 62 for securing the parts 51, 52 in one or more orientation positions. A locking member is directly formed by an edge face of the body 51 facing the axis 9 and radially spaced from the axis 49 and which is roughly located in the plane of the outlet face for the tube 52 and only locks in the non-use position of the medium outlet 8 roughly parallel to the axis 9. This edge face is concavely curved about the axis 9 and closely adapted to the associated, complimentary, convex outer circumference of the jacket 32 or the control member 13. By resilient deformation of the jacket 32 and the spacer 51 in the vicinity of the catch 62 it can be released or engaged. Through the curvature of the jacket 32 and the limited spacing of the axis 49 from the outer face 17 the locking member remains disengaged or contact-free in all other positions.

A further locking or securing member 64, making it possible to obviate the need for the catch 62, is spaced from the spacer 51 in the vicinity of the free end of the tube 52 or the medium outlet 8. If the free end of the rod body 52 in the non-use position engages in a reception opening of the cross-sectionally cup-shaped securing member 64, then it is positionally secured in non-positive manner and free from any axial and radial clearance with the exception of a single movement direction. Thus, the spacer 51 is positively secured in its rotation position with respect to the head 50 and the head 50 in the starting position against axial actuating movements with respect to the body 2, 3. In a longitudinal view of the securing rod 52 the reception opening of the securing member 64 is U-shaped, its legs at the open U-side forming an insertion opening 65 for the end of the tube 52, from which the tube end can be moved out to one side only by pivoting about the axis 49 from the member 64 tangentially to the axis 9, i.e. at right angles to the common axial plane of the axis 9 and the tube 52. At the side remote from the spacer 51 the U-opening is closed with a base 67, which forms a slidable ramp for the end face of the tube 52 rising in shallow manner from the insertion opening 65. If the tube 52 is pivoted into the insertion opening 65 counter to the direction 66, then it is pretensioned by the ramp 68 initially in its longitudinal direction until it reaches the base 67 parallel to its end face and then strikes against the U-crossbar. The securing member 64 is provided at the free end of a radial arm 69, which projects immediately adjacent to the associated end of the part 27 or 30 from the widest sleeve end of the body 3 projecting therefrom and is constructed as a spiral spring arm. The arm 39 passes in one piece into the body 3 and the one-piece constructed securing member 64 and by corresponding profiling it can resiliently give way only in the longitudinal direction of the tube 52 or the axis 9.

For the outlet opening 8 is provided a substantially tight closure, which can be opened and closed repeatedly in non-destructive manner. It surrounds the associated tube end over at least part of the outer circumference and/or engages into the interior of the tube or outlet opening 8 in pressure-tight sealing manner with a projection opening 8 can be constructed as an atomizing nozzle. In a very simple embodiment the closure 70 is formed by the locking member 64 or its base 67, so that on transfer into the securing position simultaneously and without further manipulations the outlet opening 8 is closed The apparatus 1 can be carried in hanging manner as a grip on the positionally secured rod 52 without the position securing means being releasable. Through the securing member 65 there is a positive prevention of a movement of the tube 52 parallel to the common axial plane with the axis 9. The inventive constructions can also be used for a discharge apparatus, whose reservoir content can be completely discharged in a single, straight stroke movement. In this case the inner circumference of the reservoir appropriately forms the bearing surface for the pump piston or the reservoir forms the pressure chamber or pump cylinder, which with respect to the body 3 or 50 can be axially displaced stepwise locking or continuous or striking against the pump piston.

The control bodies 16, 17 of the servodrive 12 can also be formed by one or two frontal tooth systems and for the driving or locking engagement in the particular tooth system by a swivel arm movable in resilient manner in the axial direction and which is appropriately provided on the determination or indicating member 21. The discharge apparatus 1 can be placed upright with the base of the reservoir or the like in stable manner on a standing surface such as a table and the spout 52 can be so directed over or into a glass or similar vessel alongside it that the exiting medium is received in said vessel. The vessel jacket can engage between the spout 52 and the outer circumference of the unit 2, 30, 50.

We claim:

1. A dispenser for discharging media comprising:

a base (2);

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, said indication symbols being included in a scale (22) and displayed at a position rotationally stationary with respect to said base while said detecting actuator (11) switches said detecting device (10).

2. The dispenser according to claim 1, wherein said detecting device (10) includes a visual display for said indication symbols including display symbols and ordinal numbers, said detection actuator (11) stepwise switching said display symbols in said falling direction.

3. The dispenser according to claim 1, wherein said indication symbols include an uppermost symbol corresponding to a higher storing number and further include a lowermost symbol corresponding to a lower storing number lower than said higher storing number, said data store being provided for directly switching between said higher and said lower storing number.

4. The dispenser according to claim 1, wherein said drive gear (12) includes at least two first and second control members (13, 14) drivingly interengaging in at least one reciprocal position and reciprocally freely movable in at least one out-of-engagement condition, in operation at least two of said control members (13, 14) performing differently oriented control motions, thereby said first control member (13) performing a substantially linear control motion and said second control member (14) performing a substantially rotary control motion.

5. A dispenser for discharging media comprising:

a base (2)

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein said detecting device (10) includes a detecting body (21) bearing said scale, a counterindicator (23) being provided for indicating only one of said indication symbols, when said dispenser (1) is horizontally oriented, said indication symbols being oriented in an upright position for being visually readable.

6. A dispenser for discharging media comprising:

a base (2)

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein said drive gear includes first and second members (13, 14) and first and second indicating members (23, 21), said first control member (13) being fixedly connected substantially in one part to said first indicating member (23) and said second control member (14) being fixedly connected to said second indicating member (21).

7. A dispenser for discharging media comprising:

a base (2);

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein said drive gear includes first and second control members (13, 14), said first control member (13) drivingly engaging said second control member (14) along an engagement extension, said scale (22) axially fixedly connecting to said second control member (14) and being spaced from said second control member(14) by a spacing smaller than said engagement extension (16).

8. The dispenser according to claim 7, wherein said scale (22) is directly juxtaposed and connecting to said engagement extension (16).

9. The dispenser according to claim 7, wherein at least one of said first and second control member (13, 14) includes an indicating member (21, 23), at least one of said first and second control member (13, 14) being mounted so as to substantially freely project, said second control member (14) being operationally movably mounted on said base (2) only at a location spaced from said engagement extension (16) and said scale (22).

10. A dispenser for discharging media comprising:

a base (2);

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein said detecting device (10) includes a control and indicating member (14, 21) movably engaging between opposingly spaced first and second facing surfaces, said control and indicating member (14, 21) including an engagement area (16)of said drive gear (12) and said scale (22), said first and second facing surfaces including circumferential convex outer and concave inner faces, said engagement area (16) and said scale (22) being substantially permanently located between said facing surfaces.

11. The dispenser according to claim 10, wherein said control and indicating member (14, 21) extends over a length extension including parts of said length extension, a discharge head (50) including a head jacket (32) being provided, said base (2) including a base jacket (33), only one of said parts of said length extension engaging between said head jacket (32) and said base jacket (33), means (44, 45) being provided for positively preventing removal motion of said discharge head (50) relative to said base (2), said control head (50) engaging said base (2) directly adjacent to said control and indicating member (14, 21) via said preventing means (44, 45).

12. A dispenser for discharging media comprising:

a base (2);

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein a discharge feeder (6) is provided and at least partly located inside said base (2), said discharge feeder (6) being positionally fixed to said base (2) substantially exclusively with an axially assembleable snap connection (37), said base (2) including a radially inner sleeve (35) and a radially outer sleeve (36) spacedly enveloping said inner sleeve (35), said discharge actuator (5) including an actuating head (50), said inner sleeve (35) being radially resiliently deformable and bearing said discharge feeder (6), said outer sleeve (32) positionally securing said actuating head (50).

13. A dispenser for discharging media comprising:

a base (2);

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein a discharge head (50) is provided for bearing said medium outlet (8), said medium outlet (8) being operationally displaceable with respect to said discharge head (50) to establish varying spacings and discharge positions with respect to said discharge head (50); at said medium outlet (8), the media being freed from said dispenser (1), said medium outlet (8) being provided at an end of a tube rod (52) freely projecting from said discharge head (50), said medium outlet (8) being pivotable about an axis (49) oriented transverse to a main median axis (9) of said dispenser (1).

14. A dispenser for discharging media comprising:

a base (2);

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein a discharge head (50) is provided, said discharge head (50) including a head base, a final outlet member (52) and a connecting member (51), said outlet member (52) including said medium outlet (8) spaced from an outermost boundary face of said head base, said outlet member (52) connecting to said head base exclusively via said connecting member (51), said connecting member (51) being a hollow casing.

15. A dispenser for discharging media comprising:

a base (2);

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein a length section of a prefabricated tube is provided, said length section having substantially constant cross-sections over an entire length extension extending up to tube ends, said length section being transversely separated from the tube, one of said tube ends providing said medium outlet (8).

16. A dispenser for discharging media comprising:

a base (2);

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein a discharge feeder (6) is provided, a feeder outlet of said discharge feeder (6) connecting to an outlet duct (53) separate from said discharge feeder (6), said outlet duct (53) having an inlet end and an outlet end provided by said medium outlet (8), a dressing chamber (58) for treating the medium being provided spacedly from and between said inlet end and said outlet end, said dressing chamber (58) connecting to duct sections of said outlet duct (53) including an upstream section (55) and a downstream section (59), said duct sections defining passage cross-sections and said dressing chamber (58) defining chamber passage cross-sections bigger than said passage cross-sections of at least one of said duct sections (53, 59).

17. A dispenser for discharging media comprising:

a base (2);

at least one discharge actuator (5) moveable through individual discharge cycles;

at least one medium outlet (8).

and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein said discharge actuator (5) includes an actuating head (50) operationally displaceable with respect to said base (2), position securing means (63) for positionally blocking said actuating head (50) being located substantially outside said actuating head (50).

18. The dispenser according to claim 17, wherein said position securing means (63) are provided for preventing operation of said discharge actuator (5) and rotation of said actuating head (50) including an outermost head jacket (32), said position securing means (63) being located radially spacedly outside said head jacket (32) to be manually freely accessible for locking and releasing.

19. A dispenser for discharging media comprising:

a base (2);

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein locking means (63) are provided for locking said discharge actuator (5) against operation substantially without displacing said discharge actuator (5) with respect to said base (2), said locking means (63) including a locking member (52) displaceable with respect to said base (2) for releasing said locking means (63), said locking member (52) including said medium outlet (8).

20. A dispenser for discharging media comprising:

a base (2);

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein said discharge actuator (5) includes an actuating head (50), operationally displaceable with respect to said base (2), said base (2) and said actuating head (50) providing outermost outsides including a base outside and a head outside, at least one projection (51, 64, 69) projecting over at least one of said outermost outsides and being provided for reciprocally positionally blocking said base (2) and said actuating head (50) by directly interconnecting said base (2) and said actuating head (50).

21. The dispenser according to claim 20, wherein said dispenser (1) defines an outer circumference, at least one of said projection (51, 64, 69) extending only over a minor part of said outer circumference to provide a freely projecting arm (51, 64, 69).

22. A dispenser for discharging media comprising:

a base (2);

at least one discharge actuator (5) moveable through individual discharge cycles;

at least one medium outlet (8), and at least one detecting device (10) for storing numbers of said individual discharge cycles into a data store, said data store including indication symbols rising in a rising direction toward higher numbers and falling in a falling direction towards successively lower quantities of discharge cycles, said detecting device (10) moveable to detection positions and including at least one detecting actuator (11) and at least one drive gear (12) for positively and indirectly switching said detecting device (10) successively from one of said detection positions to a next one of said detection positions, each corresponding to one of said indication symbols, wherein means are provided for presetting the number of said discharge cycles prior to manually operating said discharge actuator through said number of discharge cycles, wherein said discharge actuator (5) includes an actuating head (50) operationally displaceable with respect to said base (2), said dispenser (1) defining a circumferential dispenser outside manually freely accessible, for positionally reciprocally locking said actuating head(50)and said base (2), a connecting member (52) being provided substantially entirely outside of said dispenser outside, said connecting member (52) being inherently pressure-stiff against stresses corresponding to actuating stresses exerted by actuating said actuating head (50), said connecting member (52) substantially closing said medium outlet (8).

23. A dispenser for discharging media comprising:

a dispenser base including a medium reservoir for storing the media and a support body axially fixedly connected to said medium reservoir, said medium reservoir including a bottle component separate from said support body attached to said bottle component with a fastening member;

a discharge actuator including a plunger ram and an actuating head fixed to said plunger ram, said plunger ram defining a free ram end connected with said actuating head;

a discharge pump manually actuatable with said actuating head, said discharge pump including a pump housing comprising a main cylinder casing and a casing cover traversed by said plunger ram, said main cylinder casing defining an end receiving said casing cover, said main cylinder casing defining an outer circumferential pump face, said discharge pump being axially fixedly connected with said support body including a base cap and defining an open cap end, said discharge pump projecting inside said medium reservoir and being enveloped by said open cap end; remote from said open cap end, said base cap including a cap end wall defining an end wall inside with an end wall inside face and an end wall outside with an end wall outside face remote from said end wall inside, said cap end wall enveloping said discharge pump and sealingly supporting against said medium reservoir with said end wall inside, said discharge actuator and said discharge pump defining an initial rest position and an actuated end position remote from said initial rest position, said base cap including cap jackets axially projecting at said end wall outside, said cap jackets including an outer cap jacket, an intermediate cap jacket and an internal cap jacket, said intermediate cap jacket being radially spaced from and extending within said outer cap jacket, said internal cap jacket being radially spaced from and extending within said intermediate cap jacket and said outer cap jacket, said cap jackets defining a circumferential cap face, said casing cover being directly connected with said internal cap jacket;

a pump snap connection fixedly holding said discharge pump on said support body, said pump snap connection and said pump housing including a pump flange projecting over said outer pump circumference, said pump flange defining a first flange end face and a second flange end face remote from said first flange end face;

said actuating head including a head end wall and head jackets including at least one outer head jacket and an inner head sleeve radially spaced from and extending within said at least one outer head jacket, said head jackets defining a circumferential head face, said head end wall defining an outer head end face and an inner head end face;

said discharge actuator including a handle for manually actuating said discharge pump, said inner head sleeve defining the sleeve end frictionally engaging said free ram end, said outer head jacket externally closely enveloping said outer cap jacket;

removal prevention means for positively preventing said actuating head from returning from said actuated end position beyond said initial rest position, said removal prevention means and said head jackets including a locking cam projecting over said circumferential head face, a counter cam being included and provided on said circumferential cap face; when in said initial rest position, said locking cam positively engaging said counter cam, and media paths including a media inlet, a pump chamber, an outlet duct and a medium outlet for expelling the media off from said dispenser, said media inlet connecting said pump chamber with said medium reservoir for refilling said pump chamber with the media, said outlet duct connecting said pump chamber with said medium outlet for discharging the media out of said medium outlet, said outlet duct and said medium outlet traversing said actuating head.

24. The dispenser according to claim 23, wherein said head jackets include a cam jacket and said cap jackets include a counter cam jacket, said circumferential head face defining an inner head circumference of said cam jacket, said circumferential cap face defining an outer cap circumference of said counter cam jacket, said locking cam being made in one part with said cam jacket, said counter cam being made in one part with said counter cam jacket.

25. The dispenser according to claim 24, wherein said circumferential head face closely envelopes said circumferential cap face.

26. The dispenser according to claim 24, wherein said cam jacket freely projects towards said medium reservoir and includes a free cam jacket end including said locking cam, said head end wall radially outwardly projecting over said cam jacket and being made in one part with cam jacket.

27. The dispenser according to claim 24, wherein from said cap jackets said counter cam jacket projects away from said open cap end, said counter cam jacket freely projecting away from said open cap end and including a free counter cam jacket end, said counter cam jacket end including said counter cam.

28. The dispenser according to claim 23, wherein said inner head sleeve only frictionally engages said free ram end, said actuating head and said plunger ram being resiliently stressed towards said initial rest position, said removal prevention means permitting said actuating head to be moved and detached from said plunger ram without destruction when an increased removal force is exerted, said inner head sleeve and said plunger ram being traversed by said outlet duct.

29. The dispenser according to claim 23, wherein said intermediate cap jacket, said internal cap jacket and said base cap are commonly made in one part, said outer cap jacket being axially rigidly connected with said base cap, with respect to said cap jackets said outer cap jacket defining an outermost cap jacket.

30. The dispenser according to claim 23, wherein said medium reservoir includes a reservoir neck internally receiving said discharge pump, said base cap including a base cap jacket made in one part with said cap end wall and projecting over said end wall inside face, said base cap jacket defining said open cap end remote from said cap end wall, said base cap jacket defining an inner circumferential cap face including said fastening member, said fastening member tensioning said support body against said reservoir neck, said fastening member projecting over said inner circumferential cap face of said base cap jacket and being made in one part with said base cap.

31. The dispenser according to claim 30, wherein said fastening member defines a plug-in member and includes a radially inwardly projecting bead, said fastening member being axially spaced from said open cap end.

32. The dispenser according to claim 23, wherein said medium reservoir includes a reservoir neck including a neck end face, an annular sealing disk being included and supporting against said end wall inside face, said sealing disk being axially secured between said end wall inside face and said neck end face, said sealing disk closely enveloping said main cylinder casing, said base cap including a base cap jacket radially spacedly enveloping said main cylinder housing, said sealing disk being axially farther spaced from said open cap end than said fastening member made in one part with said base cap.

33. The dispenser according to claim 23, wherein said cap jackets include a radially resiliently expandable snap jacket including an inner circumferential snap face and a snap jacket end, said inner circumferential snap face including a snap projection engaging said first flange end face and located directly adjacent to said snap jacket end, an annular internal support shoulder being included and connecting to said inner circumferential snap face engaging said second flange end face, said snap jacket axially and radially fixedly engaging said pump housing.

34. The dispenser according to claim 33, wherein said pump snap connection sealingly holds said pump housing on said support body without a separate sealing member.

35. The dispenser according to claim 33, wherein said discharge pump is axially inserted into and assembled with said support body, said discharge pump including a piston unit including said plunger ram, said discharge duct internally traversing said piston unit, while inserting said discharge pump said pump snap connection resiliently yielding.

36. The dispenser according to claim 23, wherein said inner head sleeve projects from said inner head end face towards said open cap end, said inner head sleeve axially freely extending between said handle and said medium reservoir, said inner head sleeve being made in one part with said head end wall.

37. The dispenser according to claim 36, wherein said at least one outer head jacket projects towards said medium reservoir further than said inner head sleeve, said at least one outer head jacket being made in one part with said head end wall.

38. The dispenser according to claim 23, wherein said at least one outer head jacket includes a wide head jacket and a narrow head jacket narrower than said wide head jacket, both said wide and narrow head jackets being made in one part with said head end wall and being coaxial, said inner head sleeve being radially spaced from and extending within said narrow head jacket, said wide and narrow head jackets commonly enveloping said inner head sleeve.

39. The dispenser according to claim 23, further including an outlet valve controlling the media to flow into said discharge duct, wherein said outlet valve is axially displaceable commonly with said actuating head and said plunger ram.

40. The dispenser according to claim 39, wherein downstream of said outlet valve said discharge duct includes a radial duct section oriented radially with respect to said discharge pump, said discharge duct including an axial duct section directly connecting to said radial duct section downstream, said axial duct section being eccentric and axially substantially parallel with respect to said discharge pump.

41. The dispenser according to claim 40, wherein said actuating head defines a head cap, said actuating head further including an insertion member separate from said head cap and inserted in said head cap, said insertion member bounding said discharge duct and said radial duct section from said radial duct section up to said medium outlet, said discharge duct being free of valves, said head cap including said head jackets and said head end wall commonly made in one part.

42. The dispenser according to claim 41, wherein said head cap and said insertion member include circumferential first and second holding faces defining an inner holding circumference and an outer holding circumference, said first holding face defining said inner holding circumference and directly engaging said second holding face defining said outer holding circumference, said second holding face including circumferentially distributed protrusions engaging said first holding face, one of said first and second holding faces being made in one part with said head cap.

43. The dispenser according to claim 23, wherein said discharge head includes a rigid and oblong discharge spout diametrically narrower than said outer head jacket, said discharge spout being traversed by said discharge duct, said discharge spout including an upstream spout end and a downstream spout end located farer from said handle than said upstream spout end, said downstream spout end including said medium outlet.

44. The dispenser according to claim 43 and further including a closure for substantially sealingly closing said medium outlet, wherein said closure is provided for receiving said downstream spout end, said discharge spout being retractable out of said closure to lay bare said medium outlet.

45. The dispenser according to claim 23, wherein said actuating head is rotatable with respect to said support body when in said initial rest position.

46. The dispenser according to claim 23, wherein atomizing means are provided for discharging the media out of said medium outlet in an atomized flow, said atomizing means including a whirling chamber and at least one atomizing nozzle.

* * * * *